US006019582A

United States Patent [19]

Green

[11] Patent Number: 6,019,582

[45] Date of Patent: Feb. 1, 2000

[54] PERISTALTIC PUMP HAVING AN ELASTIC ADJUSTABLE ROTOR BODY

[75] Inventor: Andrew John Green, Falmouth, United Kingdom

[73] Assignee: Watson-Marlow Limited, Cornwall, United Kingdom

[21] Appl. No.: 08/944,302

[22] Filed: Oct. 6, 1997

[30] Foreign Application Priority Data

Oct. 7, 1996 [GB] United Kingdom ..... 9620850

[51] Int. Cl.[7] ..... F04B 43/08

[52] U.S. Cl. ..... 417/477.8

[58] Field of Search ..... 417/477.3, 477.8

[56] References Cited

U.S. PATENT DOCUMENTS

| | | | |
|---|---|---|---|
| 3,079,686 | 3/1963 | Ormsby | 417/477.8 |
| 3,787,148 | 1/1974 | Kopf | 417/477 |
| 4,043,712 | 8/1977 | Azzolini | 417/477 |
| 4,174,193 | 11/1979 | Sakakibara | 417/477 |
| 4,214,855 | 7/1980 | Gerritsen | 417/477 |
| 4,548,553 | 10/1985 | Ferster | 417/477 |
| 5,350,284 | 9/1994 | Wehling | 417/474 |
| 5,586,872 | 12/1996 | Skobelev et al. | 417/477.8 |

FOREIGN PATENT DOCUMENTS

| | | |
|---|---|---|
| 193574 | 3/1923 | United Kingdom . |
| 245057 | 1/1926 | United Kingdom . |
| 628785 | 9/1949 | United Kingdom . |
| 1498376 | 1/1978 | United Kingdom . |
| 2112464 | 7/1983 | United Kingdom . |

*Primary Examiner*—Charles G. Freay
*Assistant Examiner*—Robert Z. Evora
*Attorney, Agent, or Firm*—Duane, Morris & Heckscher, LLP

[57] ABSTRACT

A peristaltic pump includes a rotor (21) comprising a hub (211), an actuating part (214) mounted on the hub (211) for operative engagement with a flexible tube (7) of the pump, the actuating part (214) being radially displaceable relatively to the hub (211) and being connected to the hub (211) by an elastic connecting portion; and adjustment means (22) for adjusting the radial position of the actuating part (214) and for maintaining the actuating part (214) in an adjusted position.

17 Claims, 4 Drawing Sheets

PERISTALTIC PUMP HAVING AN ELASTIC ADJUSTABLE ROTOR BODY

FIELD OF THE INVENTION

The present invention relates to a peristaltic pump, and more particularly to a rotor for a peristaltic pump.

DESCRIPTION OF THE RELATED ART

A peristaltic pump includes a rotor assembly which has tube-engaging surfaces for occluding a flexible tube within the pump. As the tube-engaging surfaces rotate, fluid in the tube is forced along the tube. Thus pumping of the fluid is achieved. It is desirable to adjust the amount by which the tube is occluded by the engaging surfaces. Previous designs of rotor assembly include lubricated shims located between the rotor hub and the tube-engaging surfaces. Adjustment of the amount of occlusion of the tube is achieved by adding or removing shims. Such an operation is time-consuming, potentially inaccurate and can cause undesirable contamination of other parts of the pump.

SUMMARY OF THE INVENTION

The invention provides a rotor for a peristaltic pump. The rotor includes a hub having an actuating part for engaging a flexible tube of the pump. The actuating part is radially displaceable with respect to the hub and is connected to the hub by an elastic connecting portion. The rotor further includes a means for adjusting the radial position of the actuating part and for maintaining the actuating part in an adjusted position.

DETAILED DESCRIPTION OF THE PREFERRED EMBODIMENTS OF THE INVENTION

Figure 1:
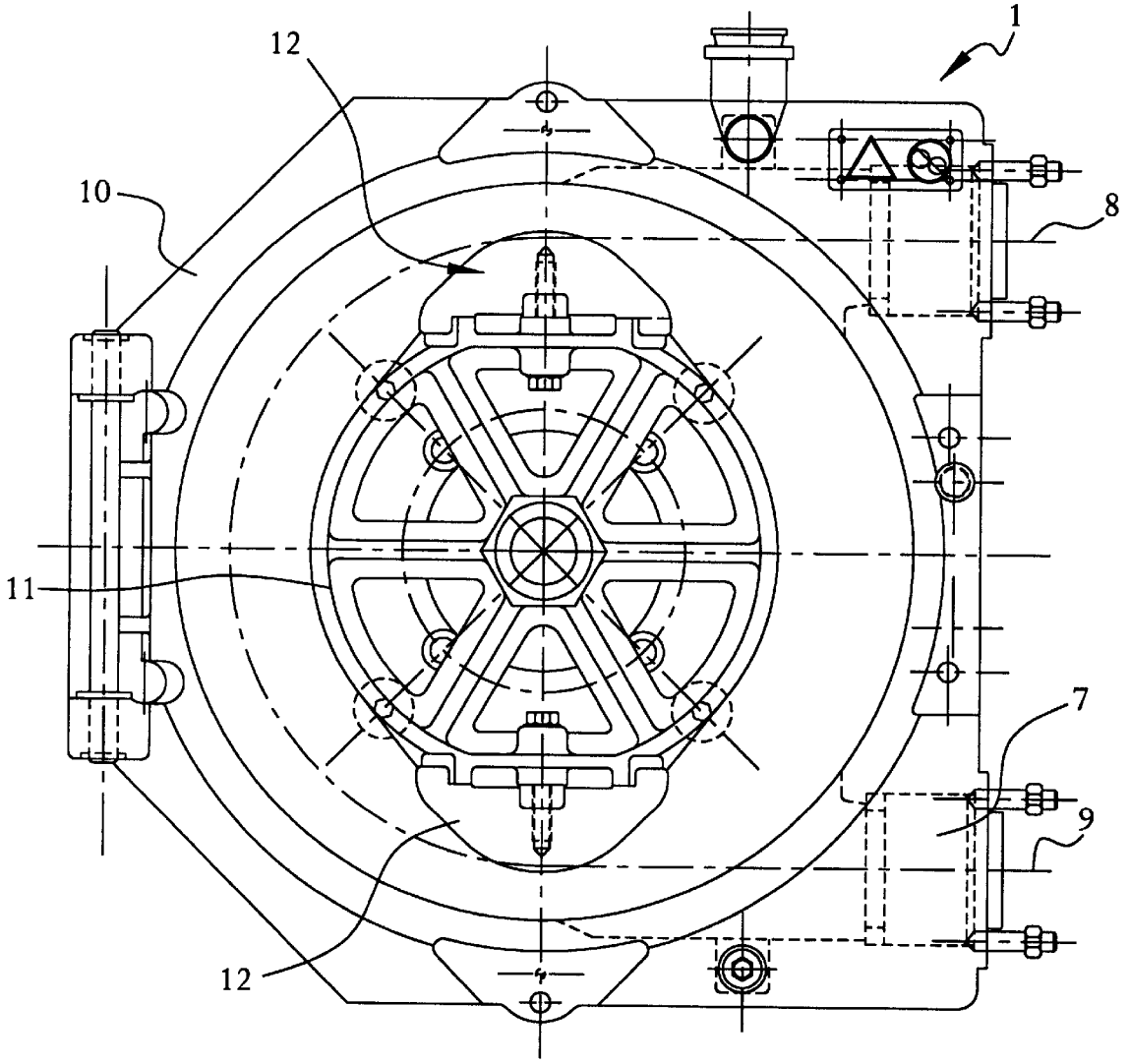
FIG. 1 is a view of a known peristaltic pump.

The peristaltic pump 1 shown in FIG. 1 comprises a housing 10 within which a rotor 11 is rotatable about an axis R. A flexible tube 7 is arranged in a U-shape around the rotor 11.

Shoes or lobes 12 which bear on the tube 7 are carried by the rotor 11 on opposite sides of the axis R.

In use, the rotor 11 is driven about the axis R, for example by means of an electric motor. The lobes 12 are thereby rotated and constrict the tube so as to occlude the passageway running through the tube. As the rotor 11 rotates, the occlusion caused by each lobe 12 translates along the length of the tube 7. In this way, fluid carried in the tube 7 is forced from one port 8 or 9 of the pump to the other port 9 or 8 of the pump, depending on the direction of rotation of the rotor 11.

The spacing of the lobes 12 from the axis R determines the amount by which the tube 7 is occluded when the pump is in use. The amount of occlusion affects the flow rate of the pump and the amount of wear experienced by the tube. The spacing of the lobes 12 from the axis R is adjusted by the use of shims 13 placed between each lobe 12 and the rotor 11.

This method of adjustment suffers from the disadvantage that it is difficult to achieve accurate and constant spacing of each lobe, because each lobe is adjusted independently of the other. Incorrect spacing of the lobes can result in increased wear of the tube 7 or in insufficient flow rate of the pump. In addition, the shims are usually covered in a lubricant, and so their removal and replacement can cause undesirable contamination of other parts of the pump.

Figure 2:
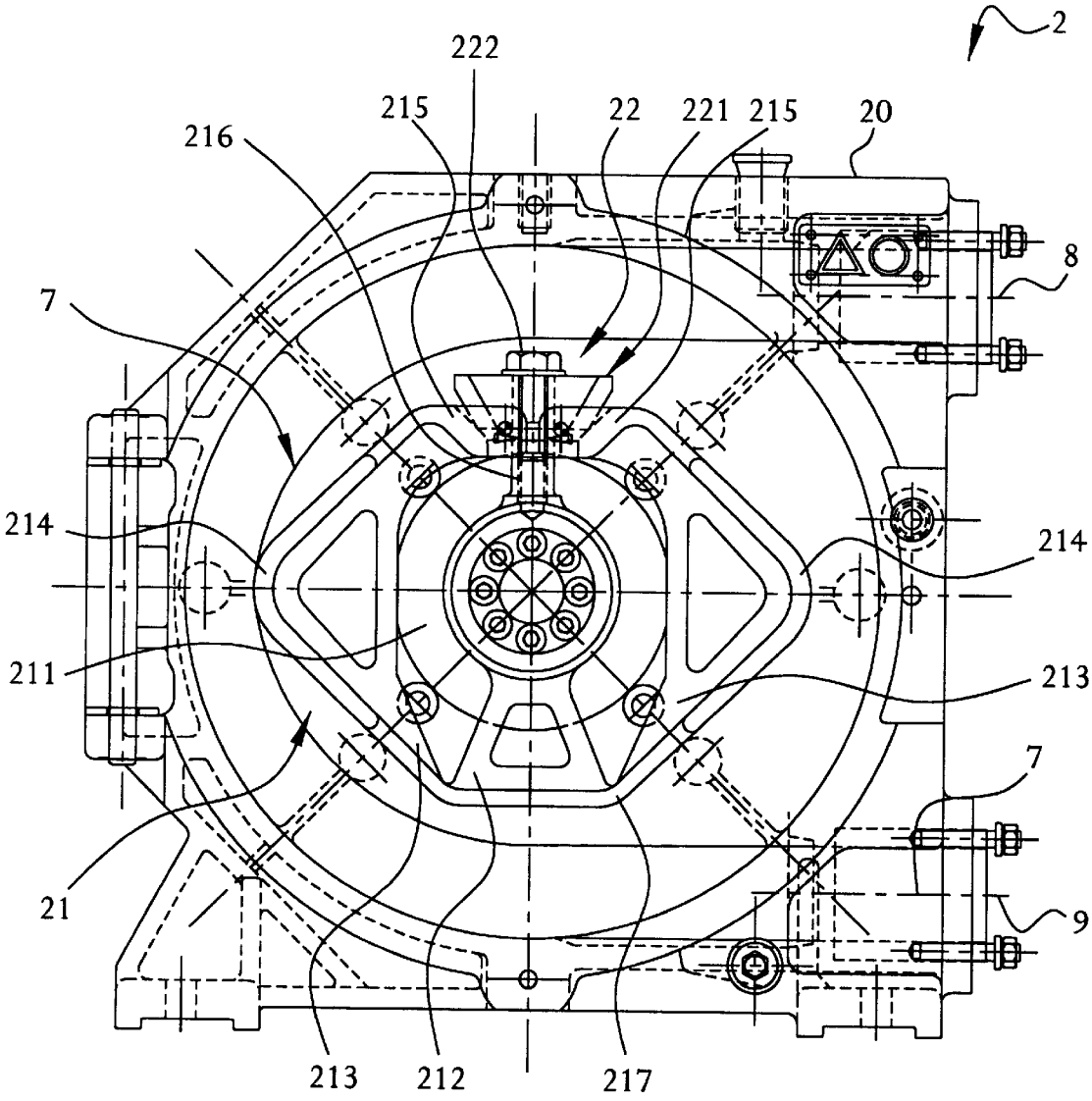
FIG. 2 is a view of a peristaltic pump having a rotor in accordance with the present invention.
Figure 3:
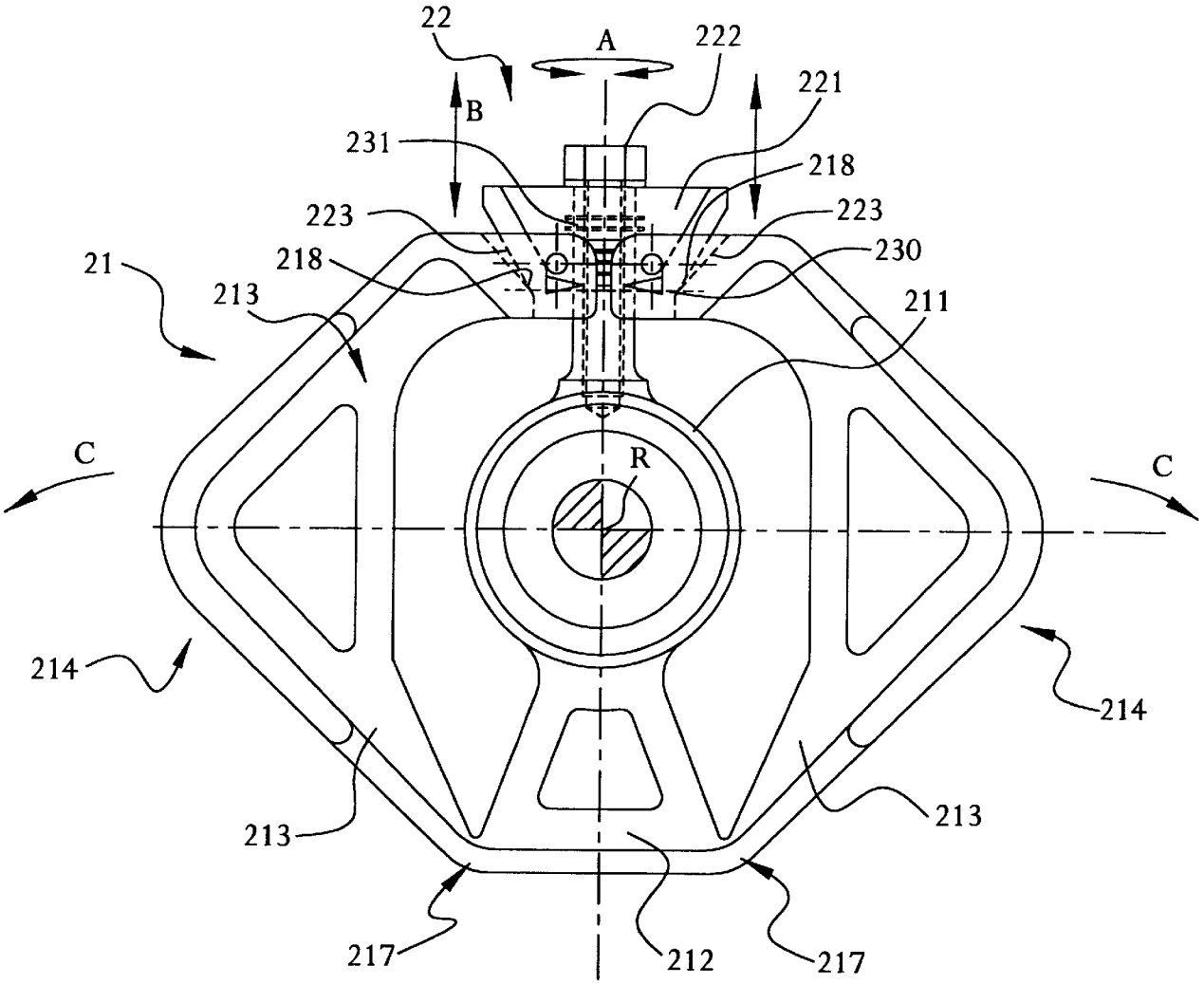
FIG. 3 is a view of part of the pump of FIG. 2.
Figure 4:
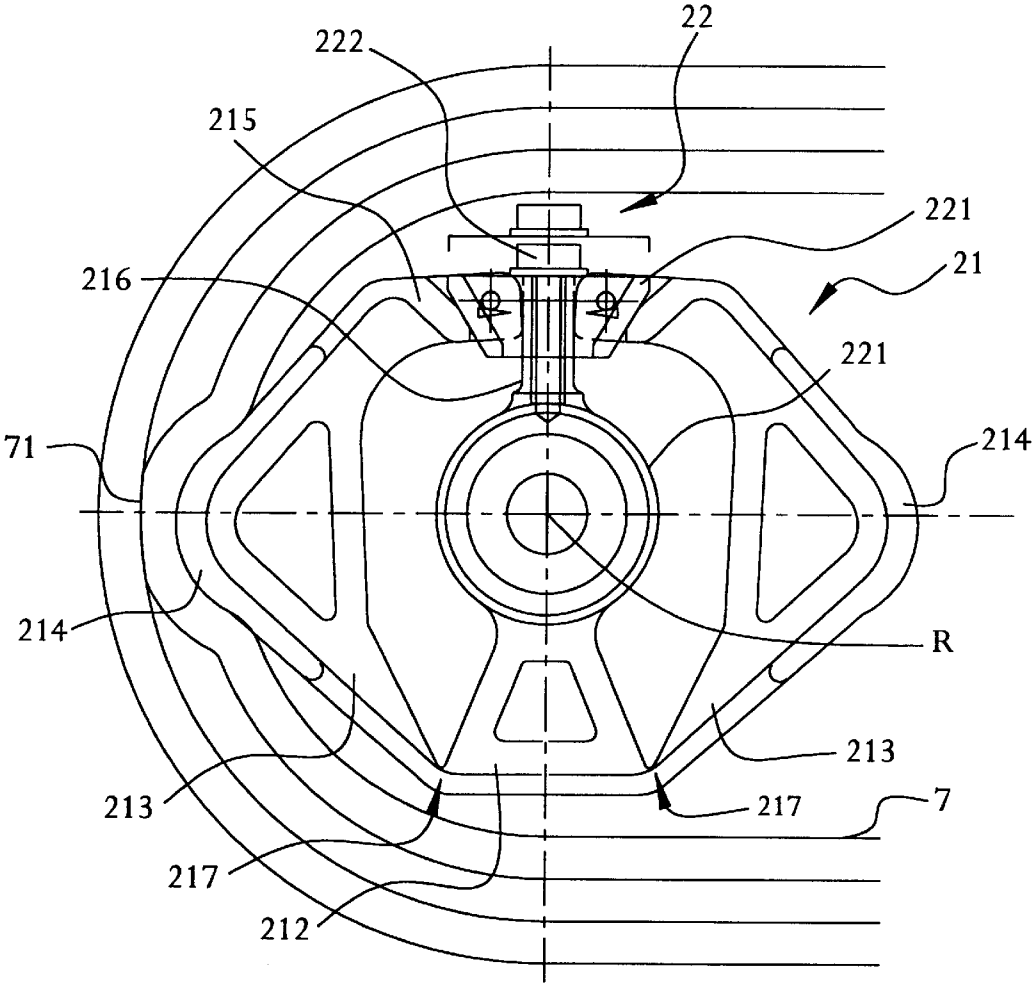
FIG. 4 shows the rotor of FIG. 2 cooperating with a flexible tube.

The pump shown in FIG. 2 comprises a housing 20 and a substantially U-shaped flexible tube 7, as in the known design, but has a different rotor assembly, as shown in more detail in FIGS. 3 and 4.

The rotor assembly comprises a main rotor body 21 having a hub 211 provided with a radial extension 212 which carries two arms 213. Each of the arms 213 is shaped so as to serve as a lobe having a tube-engaging region 214 similar in profile to those described with reference to FIG. 1. Each arm 213 is connected at one end to the radial extension 212 of the main rotor body 21. The arms 213 extend from that extension 212 to opposite sides of the axis of rotation R as shown in FIGS. 2 to 4. Each arm terminates at a free end 215 which is situated substantially opposite the radial extension 212.

Adjustment means 22 is provided which comprises an adjustment element in the form of a wedge 221, and a screwthreaded element in the form of an adjusting bolt 222. The wedge 221 is located between the free ends 215 of the arms 213. The adjusting bolt 222 passes through the wedge 221 and is threaded into a portion 216 of the hub 211.

The adjustment means 22 is used to adjust the spacing of the tube-engaging regions 214 of the arms 213 from the axis of rotation R. To increase the spacing of the tube-engaging regions 214, and thus increase the occlusion of the tube 7, the adjuster bolt 222 is screwed into the part 216. This causes the wedge 221 to move towards the axis of rotation R. As shown more clearly in FIG. 3. Cam faces 223 of the wedge 221 engage corresponding faces 218 at the free ends of the arms 213 so that as the wedge moves inwardly, the free ends 215 of the arms 213 are moved apart from each other as indicated by arrows C in FIG. 3. The arms hinge elastically about a portion 217 of the rotor 21. The resilience of the material of the rotor 21 biasses the arms into contact with the wedge 221.

In order to decrease the spacing of the tube-engaging regions 214, and thus reduce the occlusion of the tube 7, the adjusting bolt 222 is screwed out of the portion 216, thereby allowing the wedge 221 to move outwardly from the axis R. The resilient nature of the hinges formed at portions 217 causes the arms 213 to move inwardly, thereby forcing the wedge 221 outwardly into contact with the head of the adjusting bolt 222.

The free end regions 215 of the arms 213 carry measuring marks 230 and a scale 231 is marked on the wedge, so that the amount of displacement of the tube-engaging regions can be determined accurately and simply. The scale 231 is preferably graduated in terms of millimetres of occlusion of the tube.

The rotor is shown in use in FIG. 4, in which the arms 213 are in an adjusted position in which the tube 7 is completely occluded in the region 71. As the rotor (body) rotates about axis R, the occluded region 71 moves along the tube 7 so that liquid contained within the tube is pumped from one end of the tube to the other.

The rotor body 21, comprising the hub 211, the radial extension 212, the arms 213, with the regions 214 and the portion 216, is preferably made from spheroidal graphite cast iron which has elastic properties required to form the elastic hinges 217. Casting the assembly from such a material enables a single casting to be made.

The wedge is preferably machined from aluminium.

The rotor 21 shown in FIGS. 2 to 4 has a reduced number of components compared with that shown in FIG. 1, and aids simplified and foolproof adjustment of the occlusion of the tube. Adjustment is made by one simple action which adjusts the position of both of the lobes.

Such an improved design results in cleaner operation since no shims which are usually covered in lubricant are used. The design also provides clear indication of the occlusion setting, and can achieve prolonged life of the tube by enabling the occlusion setting to be optimised.

I claim:

1. A rotor for a peristaltic pump, the rotor comprising:

a hub;

an actuating part mounted on and formed integrally with the hub for engaging a flexible tube of the pump, for operating the pump, the actuating part being radially displaceable relative to an axis defined by the hub and being connected to the hub by an elastic region of the material of the rotor; and an adjustment means for adjusting the radial position of the actuating part and for maintaining the actuating part in an adjusted position.

2. A rotor as claimed in claim 1, in which the hub and the actuating part are made from spheroidal graphite cast iron.

3. A rotor as claimed in claim 1, in which there are two said actuating parts disposed on opposite sides of the hub.

4. A rotor as claimed in claim 3, in which the adjustment means is common to both actuating parts.

5. A rotor as claimed in claim 1, in which the adjustment means comprises an adjustment element having a cam surface.

6. A rotor as claimed in claim 5, in which the cam surface engages the actuating part, the adjustment element being displaceable relative to the hub to displace the cam surface relative to the actuating part.

7. A rotor as claimed in claim 6, in which there are two said actuating parts disposed on opposite sides of the hub, in which the cam surface on the adjustment element is one of two cam surfaces which engage the respective actuating parts, whereby displacement of the adjustment element causes displacement of both actuating parts.

8. A rotor as claimed in claim 5 in which the adjustment element is displaceable relative to the hub by means of a screwthreaded element.

9. A rotor as claimed in claim 1, wherein the actuating part includes a convex lobe for engagement with the tube.

10. A rotor as claimed in claim 1, in which the actuating part comprises an arm which is connected at one end to the hub, and a cube-engaging part disposed between the ends of the arm.

11. A rotor as claimed in claim 10, in which the adjustment means acts on the other end of the arm.

12. A peristaltic pump comprising a rotor and a flexible tube extending around the rotor, the rotor comprising:

a hub;

an actuating part mounted on and formed integrally with the hub for engaging the flexible tube, for operating the pump, the actuating part being radially displaceable relative to an axis defined by the hub and being connected to the hub by an elastic region of the material of the rotor; and an adjustment means for adjusting the radial position of the actuating part and for maintaining the actuating part in an adjusted position.

13. The pump as claimed in claim 12, in which there are two actuating parts disposed on opposite sides of the hub.

14. The pump as claimed in claim 12, in which the adjustment means is common to both actuating parts.

15. The pump as claimed in claim 14, in which the adjustment means comprises an adjustment element having a cam surface.

16. The pump as claimed in claim 15, in which the cam surface engages the actuating part, the adjustment element being displaceable relatively to the hub to displace the cam surface relative to the actuating part.

17. The pump as claimed in claim 15, in which the adjustment is displaceable relative to the hub by means of a screwthreaded element.

* * * * *